US009752313B2

(12) United States Patent
Simon

(10) Patent No.: US 9,752,313 B2
(45) Date of Patent: Sep. 5, 2017

(54) DRAINAGE CHANNEL FOR LIQUID RELOCATION AND LINER THEREFOR

(75) Inventor: Thomas Simon, Statesville, NC (US)

(73) Assignee: ABT, INC., Troutman, NC (US)

( * ) Notice: Subject to any disclaimer, the term of this patent is extended or adjusted under 35 U.S.C. 154(b) by 1165 days.

(21) Appl. No.: 12/867,236

(22) PCT Filed: Feb. 11, 2009

(86) PCT No.: PCT/US2009/033829

§ 371 (c)(1),
(2), (4) Date: Jan. 19, 2011

(87) PCT Pub. No.: WO2009/102812

PCT Pub. Date: Aug. 20, 2009

(65) Prior Publication Data

US 2011/0110719 A1 May 12, 2011

Related U.S. Application Data

(60) Provisional application No. 61/027,632, filed on Feb. 11, 2008.

(51) Int. Cl.
*E02B 5/00* (2006.01)
*E03F 3/04* (2006.01)

(52) U.S. Cl.
CPC ..... *E03F 3/046* (2013.01)

(58) Field of Classification Search
USPC ..... 405/118, 119, 122
See application file for complete search history.

(56) References Cited

U.S. PATENT DOCUMENTS

| | | | | |
|---|---|---|---|---|
| 1,180,621 | A * | 4/1916 | Thorsby | 405/122 |
| 5,160,221 | A * | 11/1992 | Rohe et al. | 405/270 |
| 5,256,000 | A | 10/1993 | Beamer | |
| 5,613,804 | A | 3/1997 | Beamer | |
| 5,735,638 | A * | 4/1998 | Beamer | 405/119 |
| 6,722,818 | B1 | 4/2004 | Suazo | |
| 6,755,596 | B2 * | 6/2004 | Schibi | 405/270 |
| 7,165,914 | B2 * | 1/2007 | Suazo | 405/121 |
| 7,967,523 | B2 * | 6/2011 | Hetzler et al. | 404/4 |
| 2002/0172561 | A1 * | 11/2002 | Markusch et al. | 405/118 |

FOREIGN PATENT DOCUMENTS

JP 6-185035 7/1994

OTHER PUBLICATIONS

International Search Report and Written Opinion for PCT/US2009/033829 as issued Sep. 24, 2009.
Canadian Intellectual Property Office. Canadian Office Action and Examination Search Report dated Feb. 27, 2015. Canadian Patent Application No. 2,715,336. Name of Applicant: ABT, Inc. English Language. 4 pages.

* cited by examiner

*Primary Examiner* — Thomas B Will
*Assistant Examiner* — Katherine Chu
(74) *Attorney, Agent, or Firm* — Moore & Van Allen PLLC; Henry B. Ward, III

(57) ABSTRACT

Embodiments of the present invention include a drainage channel comprising a first barrier for containment and a second barrier for containment. In one embodiment, the second barrier comprises a liner and a support. In a further embodiment, the support substantially secures at least a portion of the second barrier in the first barrier.

20 Claims, 3 Drawing Sheets

DRAINAGE CHANNEL FOR LIQUID RELOCATION AND LINER THEREFOR

CROSS-REFERENCE TO RELATED APPLICATION

This application claims priority from U.S. provisional patent application Ser. No. 61/027,632, filed Feb. 11, 2008, and entitled "Drainage Channel for Liquid Relocation and Liner Therefor."

INTRODUCTION

The present invention relates generally to drainage systems, and more particularly, to a drainage channel or trench having an inner liner. Thus, the channel and liner provide two barriers for containment of liquids moving along the length of the channel or trench.

Drainage and other trenches of various sizes and contours are desirable for a number of applications. For example, manufacturing facilities, chemical plants, laboratories, and the like typically require drainage systems that include trenches formed in the building floors to collect, remove, and/or recycle excess water or other liquids. In addition, numerous outdoor industrial and commercial sites, such as parking lots and parking decks, require drainage systems, including trenches, to collect and direct rainwater and other liquids to underground storm sewers to prevent flooding and to decrease run-off. Similarly, roadways, driveways, runways, and the like may also require drainage systems, including trenches.

In many instances these channels and trenches are used to transport harmful or contaminated liquids from one area to the next while protecting the surrounding environment. Without properly relocating these liquids, harmful or contaminated liquids could come into contact with other surfaces thus damaging those surfaces, or they could be absorbed into the ground where they could kill plant and animal life or seep into water supplies. There are issues with traditional drainage channels or trenches becoming cracked or split through corrosion, natural disaster, such as an earthquake, environmental effects, stresses caused by accidents, thermal expansion and contraction, or similar types of damaging events. In many cases, such as for draining rain water, a crack may not be a major concern because water may be able to seep into the ground without causing harm. However, in cases where the water or liquid is harmful or contaminated, a crack in the drainage channel may prove devastating to the surrounding environment. Thus, there is a need to provide a secondary barrier in case the primary barrier, the drainage channel, becomes damaged and liquids are able to escape the drainage channel or trench.

For example, in one embodiment of the present invention a traditional drainage channel may be fitted with a liner that generally forms to the interior contour of the drainage channel and runs the entire length of the channel. The drainage channel and liner provide a primary and secondary barrier to prevent materials from leaking into the surrounding environment.

In some embodiments, the liner is attached to spring inserts that are placed into a traditional drainage channel and the assembly is secured within the channel by the spring force of the inserts. In other embodiments, the liner can be secured within the drainage channel through the frame elements that are typically used to attach the grate covers to the drainage channel. Still, in other embodiments the liner can be form fitted to the inside of the drainage channel wall, so no attachment mechanism is necessary. In other embodiments, mechanical mechanisms are used to attach the liner to the wall of the drainage channel.

BRIEF SUMMARY OF SELECTED EMBODIMENTS OF THE INVENTION

Embodiments of the invention provide apparatuses and methods for providing a drainage channel comprising a first barrier for containment and a second barrier for containment. In one embodiment, the second barrier comprises a liner and a support, where the support substantially secures at least a portion of the second barrier in the first barrier. In another embodiment, the second barrier further comprises a fastener configured to substantially secure the liner to the support. In yet another embodiment, the drainage channel comprises a sealant positioned substantially adjacent to the fastener to deter moisture from entering a space between the first barrier and the second barrier.

In one embodiment, the support biases at least a portion of the second barrier towards the first barrier. In a further embodiment, the contour of the cross-section of the support is generally the same as the contour of the cross-section of the first barrier. In another embodiment, the support defines first and second end portions, where the first and second end portions are biased toward a corresponding side of the first barrier.

In one embodiment, the first barrier is generally U-shaped. In another embodiment, the first barrier is formed from a material selected from the group consisting of a cementitious material and a polymer concrete. In a further embodiment, the liner is generally U-shaped. In another embodiment, the liner is formed from a substantially seamless, monolithic material. And in a further embodiment, the liner is formed from a polymer material.

In one embodiment, the drainage channel further comprising a frame substantially secured to the first barrier and for supporting a drainage grate. In another embodiment, the drainage channel further comprises a sensor positioned between the support and the liner, where the sensor is configured to detect moisture.

Embodiments of the present invention also provide a method for constructing a drainage channel by the forming a trench, placing a first barrier for containment at least partially in the trench and placing at least a portion of a second barrier for containment in the first barrier. In one embodiment, the second barrier comprises a liner and a support for substantially securing at least a portion of the second barrier in the first barrier. In another embodiment, the method further comprises securing a frame to the first barrier, wherein the frame is configured for supporting a drainage grate. In yet another embodiment, the method further comprises providing a grate and placing the grate on the frame.

In one embodiment, the second placing step comprises biasing the support inwardly until at least a portion of the second barrier is in the first barrier and then unbiasing the support. In another embodiment, the second placing step comprises fastening a fastener to the second barrier to substantially secure the liner to the support.

In one embodiment, the method further comprises applying a sealant substantially adjacent to the fastener to deter moisture from entering a space between the first barrier and the second barrier. In another embodiment, the method further comprises placing a sensor between the support and the liner, where the sensor is configured to detect moisture.

BRIEF DESCRIPTION OF THE DRAWINGS

Figure 1:
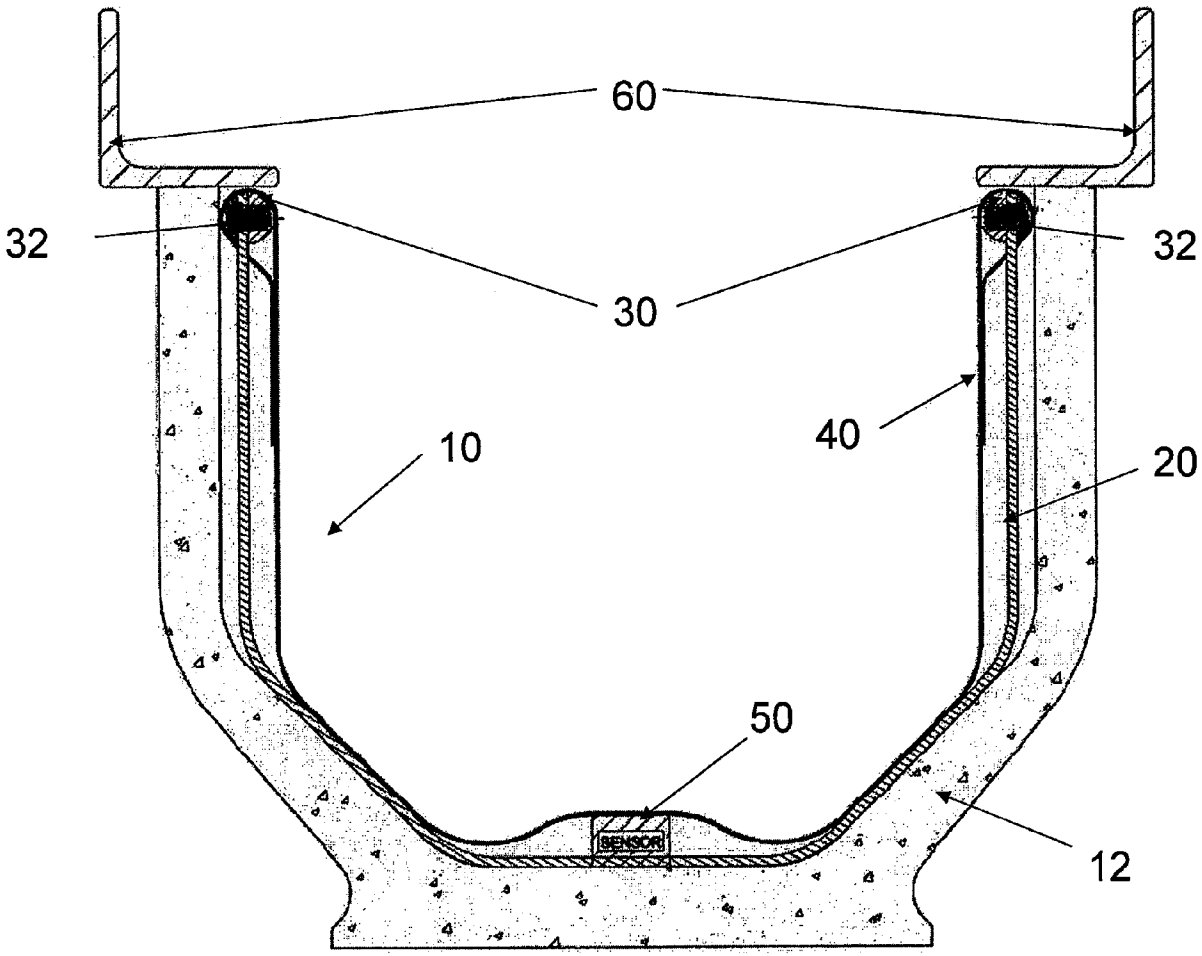
Figure 2:
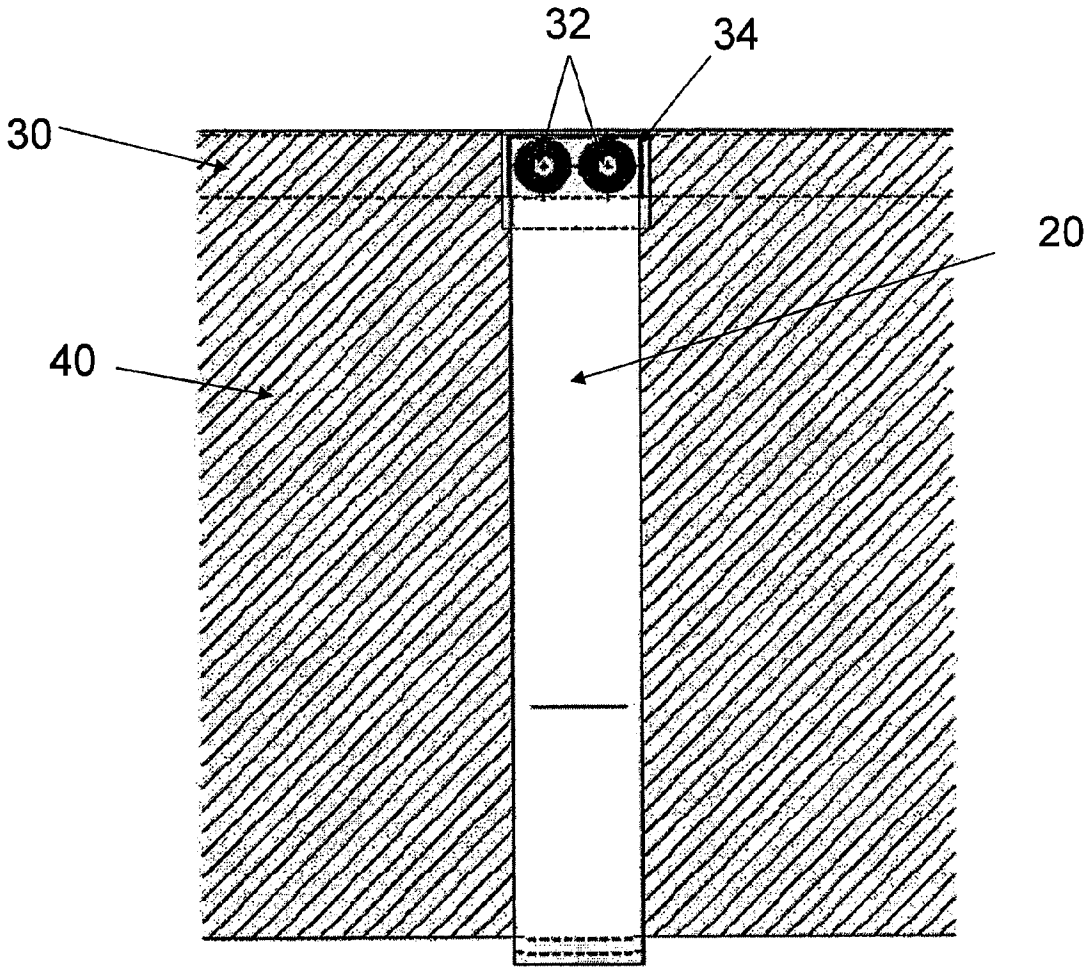
Figure 3:
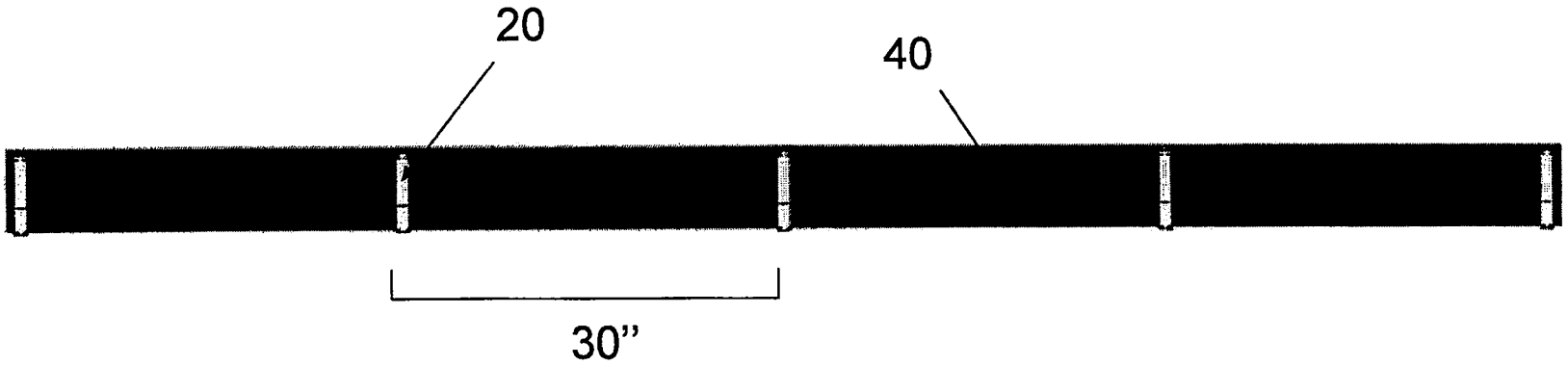

Having thus described embodiments of the invention in general terms, reference will now be made to the accompanying drawings, which are not necessarily drawn to scale, and wherein:

FIG. 1 is a cross-section elevational view illustrating a drainage channel, in accordance with an embodiment of the present invention;

FIG. 2 is a side elevational view illustrating a drainage channel, in accordance with an embodiment of the present invention; and FIG. 3 is a bottom view illustrating a drainage channel, in accordance with an embodiment of the present invention.

DETAILED DESCRIPTION OF EMBODIMENTS OF THE INVENTION

Embodiments of the present invention will now be described with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout. It will be understood that the terms "a" and "an" shall mean "one or more" where possible, even though the phrase "one or more" is also used herein. Further, it will also be understood that, where possible, the singular form of a word shall also mean the plural form of the word and vice versa.

FIGS. 1, 2, and 3 illustrate one exemplary embodiment of the present invention. FIG. 1 illustrates a cross-sectional view of a drainage channel assembly 10 in accordance with an embodiment of the present invention. The drainage channel assembly 10 contains a channel body 12, one or more supports 20, one or more spacer bars 30, one or more screws 32, a liner 40, one or more sensors 50, and one or more channel frames 60. The cross-sectional view shown in FIG. 1 illustrates a cross-section elevational view taken at the location of one of the supports 20 in the drainage channel assembly 10. FIG. 2 shows a side elevational view of a portion of the drainage channel assembly 10 before it is secured within the channel body 12. The portion of the drainage channel assembly 10 that is secured within the channel body 12 is also referred to herein as the second barrier for containment, and principally comprises a liner 40 and supports 20. FIG. 3 shows a bottom view of a portion of the drainage channel assembly 10 before it is inserted into the drainage channel body 12.

Referring to FIG. 1, an exemplary channel body 12, also referred to herein as a first barrier for containment, is illustrated having a generally U-shaped cross-section comprised of two opposed generally-vertical walls and a base. The internal surface of the channel body 12 forms a generally U-shaped trench. Although the illustrated channel body 12 and trench contour may be preferable for some applications, other embodiments of the invention may utilize a channel body 12 and trench with a different cross-sectional contour. For example, in some embodiments the channel body 12 may form a trench having a rectangular or a semi-circular cross-section.

In the illustrated embodiment, the channel body 12 is made from a polymer concrete and/or some other cementitious material, which is formed into the illustrated contour. In other embodiments, however, the channel body 12 may be formed from other materials, such as a metallic or polymeric material. In still other embodiments, the trench may be formed from a cutout in the ground or other surface, i.e., the channel body 12 may be comprised of the ground or other surface in which the trench is formed.

As illustrated in FIGS. 1-3, a plurality of supports 20 are placed into the trench formed by the channel body 12 to hold the liner 40 within the trench. The support 20 is an insert spacer that, in the illustrated embodiment, has a cross-section contour that is generally the same contour of the cross-section of the channel body 12 and/or internal surface of the channel body 12. The support 20 may be made of stainless steel or some other material with spring-like properties, such as other metallic materials, some rigid or semi-rigid polymers, or the like. In the exemplary embodiment illustrated in FIG. 1, the support 20 is comprised of a 3/32-inch thick and one-inch wide strip of stainless steel. However, the dimensions of the supports 20 may vary in other embodiments of the invention based on the particular application and the materials used.

Referring to FIGS. 1 and 2, the supports 20 are attached to two opposing spacer bars 30 that, when inserted into the channel body 12, run along the length of the channel generally parallel to the trench's longitudinal axis. In one embodiment of the invention the spacer bars 30 are comprised of bars that have a length that is substantially equal to the length of the drainage channel. In other embodiments, the spacer bars 30 are made of a plurality of individual bar sections that are secured together by any of a variety of techniques known in the art for securing bars together end-to-end.

In the illustrated embodiment, the spacer bars 30 are comprised of rods with one-half (½) inch diameter circular cross-sections. However, it is understood that bars of any number of dimensions or contours may be used, such as a one-inch thick rod, or a rod with a rectangular or triangular cross section.

In the illustrated embodiment of the invention, one of the functions of the spacer bars 30 is to hold a plurality of supports some predetermined distance apart from one another along the axially length of the trench. As illustrated in FIGS. 1 and 2, in one embodiment the spacer bars 30 have notched sections 34 where the ends of the supports 20 are attached. More particularly, in one embodiment an outside portion of the circular spacer bars 30 is notched at various spaced-apart locations so that a generally flat surface is created on the outside of the bar 30. The end of a support 20 can then be placed against and adhered to the flat surface of the bar 30 in the notched section 34.

For example, in the illustrated embodiment, through-holes are located at the ends of the supports 20 and threaded holes are located within the notched sections 34 of the spacer bars 30. As illustrated in FIG. 2, two screws 32 may then be used to attach the supports 20 to the spacer bars 30 by disposing the screws through the holes in the supports 20 and into the threaded holes in the spacer bars 30. It is understood that while, in this embodiment, screws and through-holes were used to attach the supports 20 to the spacer bars 30, many other fasteners or securing methods commonly known in the art at the time of this invention may be used to secure the springs 20 to the bars 30, such as rivets, solder, welds, clips, press-fit designs, adhesives, etc. As depicted in FIG. 3, in one exemplary embodiment of the present invention the supports 20 and spacer bar notches 34 are located thirty (30) inches from one another; however, the distance between supports 20 and spacer bar notches 34 may vary in other embodiments based on the particular application.

The liner 40 of the assembly 10 is then placed on the inside surface of the supports 20 and draped over the outside edges of the spacer bars 30, thus covering most of the bar 30 along the length of the trench. In one embodiment of the present invention, the liner 40 is formed of a substantially seamless, monolithic material to reduce the chances of the liner having a leak at a seam. In other embodiments, the liner material is made of sections that are secured together and sealed at the seams to prevent leaking. In an exemplary embodiment, the liner is comprised of a polyester fiber weave coated in an ethylene inter-polymer alloy. However, in other embodiments, the liner may be made of high density polyethylene, polypropylene, PVC, hypalon, or any other type of material that can meet the drainage channel requirements for the particular application. For example, where the drainage channel may be collecting a particular type of corrosive chemical, the liner material must be properly selected so that it can withstand the corrosive properties of the chemical.

As illustrated in FIG. 2, the liner 40 may be generally U-shaped and/or generally conform to the cross-section contour of the channel body 12. the liner 40 may be notched at the location of each support 20 so that the notched sections 34 of the spacer bar 30 is exposed, thereby allowing the ends of the supports 20 to be coupled to the spacer bar 30. As visible in FIG. 1, in one embodiment the liner 40 is secured to the spacer bars 30 by folding a portion of the liner over the top of the spacer bar 30 and adhering the liner to itself below the support bar 30. In another embodiment, the liner 40 is substantially secured to the supports 20 by screws 32. In a further embodiment, a sealant is positioned and/or is applied to an area substantially adjacent to the screws 32 to deter moisture from entering a space between the liner 40 and the channel body 12. In one embodiment, the sealant is a liquid and/or solid silicone sealant.

In general, the supports 20, spacer bars 30, and liner 40 are all assembled together outside of the trench formed by the channel body 12 and then inserted into the drainage channel body 12. The supports 20 are spring loaded so that, to insert the assembly into the drainage channel body 12 the opposing spacer bars 30 must be squeezed together to allow the supports 20 to fit inside of the body 12. When the assembly is inside the drainage channel cavity the spring force is released and it pushes the outside edges of the supports 20 and spacer bars 30 against the inside walls of the drainage channel body 12, thus securing the liner 40 to the inside of the channel body 12. Furthermore channel frames 60, which may be used, for example, for attaching drainage grates (not shown), may extend along the top edges of the channel body's sidewalls and positioned such that they cover the spacer bars 30, thereby further preventing the spacer bars 30 from sliding out of the drainage channel body 12. In some embodiments, the channel frames 60 are adhered in their locations at the top edges of the channel body 12 before the liner assembly is inserted into the channel body 12. In such an embodiment, the supports 20 must be sufficiently flexible so that they can be inserted through the smaller trench opening created by the channel frames 60. In other embodiments, however, the channel frames 60 are adhered in their locations at the top edges of the channel body 12 after the liner assembly is inserted into the channel body 12.

In one embodiment, the supports 20 have a cross-section contour that is wider than the cross-section contour of the channel body 12 before the supports 20 are placed in the channel body 12. In such an embodiment, when the supports 20 are placed into the channel body 12, the resilient properties of the supports 20 create an outward biasing force on the channel body 12, as described above. In one embodiment, each of the supports 20 define first and second end portions that are biased toward a corresponding side of the channel body 12. In another embodiment, the first and second end portions are biased away from one another when the supports 20 are placed in the channel body 12. However, where channel frames 60 are positioned at the top edges of the channel body 12 and create a smaller opening at the top of the channel, the supports 20 may have a cross-section width that is greater than the upper opening in the trench (i.e., the space between the channel frames 60), but not necessarily greater than the cross-section width of the channel body 12. In general, however, it is desirable for the supports 20 to exert some outward force on the channel body 12 to not only retain the liner assembly within the channel body 12, but also to prevent the liner assembly from sliding relative to the channel body 12 along the axial length of the trench.

In one embodiment of the present invention before the supports 20, spacer bars 30, and liner 40 are secured within the drainage body 12, sensors 50 are inserted between the supports 20 and the liner 40. In another embodiment, the sensors 50 may be positioned anywhere between the liner 40 and the channel body 12. The sensors are used to detect any moisture between the inner surface of the drainage channel body 12 and the outer surface of the liner 40, in order to detect any potential leaks in the liner. In some embodiments, the sensors 50 are comprised of electrical sensors that detect the presence of moisture or of some particular type of undesirable fluid, and send signals from the sensors 50 to a gauge, a computer, or some other indicator, which someone can check to determine the integrity of the liner 40.

In other embodiments sensors 50 would wick fluid away from the drainage channel and send it to the inspection port, which would indicate to an observer whether or not the liner 40 had a leak. Such sensors 50 could be connected to a central inspection port located outside of the drainage channel body 12 or to individual inspection ports located along the length of the drainage channel.

Specific embodiments of the invention are described herein. Many modifications and other embodiments of the invention set forth herein will come to mind to one skilled in the art to which the invention pertains having the benefit of the teachings presented in the foregoing descriptions and the associated drawings. Therefore, it is to be understood that the invention is not to be limited to the specific embodiments disclosed and that modifications and other embodiments and combinations of embodiments are intended to be included within the scope of the appended claims. Although specific terms are employed herein, they are used in a generic and descriptive sense only and not for purposes of limitation.

What is claimed is:

1. A drainage channel comprising:

a first barrier for containment; and a second barrier for containment comprising:

a first spacer bar and a second spacer bar, a support, said support defining first and second end portions, said first and second end portions being biased toward a corresponding side of said first barrier, said first end portion being secured to said first spacer bar and said second end portion being secured to said second spacer bar, wherein said support substantially secures at least a portion of said second barrier in said first barrier, wherein said support is formed from a rigid or semi-rigid material, and a liner, said liner defining first and second portions, said first portion positioned around said first spacer bar and secured to itself, said second portion positioned around said second spacer bar and secured to itself, wherein said liner is formed from a flexible material.

2. The drainage channel of claim 1, wherein said second barrier further comprises a fastener configured to substantially secure said liner to said support.

3. The drainage channel of claim 2, further comprising a sealant positioned substantially adjacent to said fastener to deter moisture from entering a space between said first barrier and said second barrier.

4. The drainage channel of claim 1, wherein the contour of the cross-section of said support is generally the same as the contour of the cross-section of said first barrier.

5. The drainage channel of claim 1, wherein said first barrier is generally U-shaped.

6. The drainage channel of claim 1, wherein said first barrier is formed from a material selected from the group consisting of a cementitious material and a polymer concrete.

7. The drainage channel of claim 1, wherein said liner is generally U-shaped.

8. The drainage channel of claim 1, wherein said liner is formed from a substantially seamless, monolithic material.

9. The drainage channel of claim 1, wherein said liner is formed from a polymer material.

10. The drainage channel of claim 1, further comprising a frame substantially secured to said first barrier and for supporting a drainage grate.

11. The drainage channel of claim 1, further comprising a sensor positioned between said support and said liner, wherein said sensor is configured to detect moisture.

12. A method for constructing a drainage channel, the method comprising:

forming a trench;

placing a first barrier for containment at least partially in the trench;

providing a second barrier, the second barrier comprising:

a first spacer bar and a second spacer bar, a support for substantially securing the at least a portion of the second barrier in the first barrier, the support defining first and second end portions, the first end portion being secured to the first spacer bar and the second end portion being secured to the second spacer bar, wherein the support is formed from a rigid or semi-rigid material, and a liner, the liner defining first and second portions, the first portion positioned around the first spacer bar and secured to itself, the second portion positioned around the second spacer bar and secured to itself, wherein the liner is formed from a flexible material; and placing at least a portion of the second barrier for containment in the first barrier so that the first and second end portions of the support are biased toward a corresponding side of the first barrier.

13. The method of claim 12, further comprising securing a frame to the first barrier, wherein the frame is configured for supporting a drainage grate.

14. The method of claim 13, further comprising providing a grate and placing the grate on the frame.

15. The method of claim 12, wherein said second placing step comprises biasing the support inwardly until the at least a portion of the second barrier is in the first barrier and then unbiasing the support.

16. The method of claim 12, wherein said second placing step comprises fastening a fastener to the second barrier to substantially secure the liner to the support.

17. The method of claim 16, further comprising applying a sealant substantially adjacent to the fastener to deter moisture from entering a space between the first barrier and the second barrier.

18. The method of claim 12, further comprising placing a sensor between the support and the liner, wherein the sensor is configured to detect moisture.

19. The drainage channel of claim 1, further comprising a frame substantially secured to a top portion of said first barrier and for supporting a drainage grate, said frame defining a first frame portion that extends to vertically cover at least a portion of said first spacer bar and a second frame portion that extends to vertically cover at least a portion of said second spacer bar, said first and second frame portions securing said spacer bars within said first barrier.

20. The drainage channel of claim 1, wherein the liner is formed of a substantially seamless monolithic material comprising a polyester fiber weave coated in an ethylene interpolymer alloy.

* * * * *